US008668631B1

(12) United States Patent
Riley

(10) Patent No.: US 8,668,631 B1
(45) Date of Patent: Mar. 11, 2014

(54) EXERCISE DEVICE AND ASSOCIATED METHODS

(75) Inventor: Forbes Riley, St. Petersburg, FL (US)

(73) Assignee: Midvale Direct LLC, St. Petersburg, FL (US)

( * ) Notice: Subject to any disclaimer, the term of this patent is extended or adjusted under 35 U.S.C. 154(b) by 0 days.

(21) Appl. No.: 12/970,655

(22) Filed: Dec. 16, 2010

Related U.S. Application Data

(60) Provisional application No. 61/287,096, filed on Dec. 16, 2009.

(51) Int. Cl.
*A63B 21/02* (2006.01)

(52) U.S. Cl.
USPC ..... 482/126; 482/44; 482/45

(58) Field of Classification Search
USPC ..... 482/44, 45, 46, 47, 48, 49, 92, 110, 482/126, 148, 904, 906; 446/253, 254; D21/455, 463, 692, 694; 273/451
See application file for complete search history.

(56) References Cited

U.S. PATENT DOCUMENTS

| | | | | | |
|---|---|---|---|---|---|
| 1,431,604 | A | * | 10/1922 | Stemons | 446/214 |
| D165,752 | S | * | 1/1952 | Heim | D21/463 |
| 3,052,060 | A | * | 9/1962 | Wohlstrom | 446/22 |
| 3,516,195 | A | * | 6/1970 | Batley | 446/254 |
| D219,464 | S | * | 12/1970 | Pearce | D21/463 |
| 3,737,162 | A | * | 6/1973 | Wood | 482/110 |
| 4,953,854 | A | * | 9/1990 | Pizur, Sr. | 482/148 |
| 5,512,028 | A | * | 4/1996 | Sparks, III | 482/92 |
| 5,674,159 | A | * | 10/1997 | Davidson | 482/92 |
| 6,120,342 | A | * | 9/2000 | Chan | 446/254 |
| 6,482,137 | B2 | * | 11/2002 | Walker | 482/110 |
| D579,991 | S | * | 11/2008 | Arnstein | D21/694 |
| 2004/0009850 | A1 | * | 1/2004 | Teff | 482/79 |
| 2010/0015883 | A1 | * | 1/2010 | Boudreaux | 446/253 |

* cited by examiner

*Primary Examiner* — Glenn Richman
(74) *Attorney, Agent, or Firm* — Thorpe North & Western LLP

(57) ABSTRACT

An exercise device comprises a pair of outer handles and an inner, central disk, rotatable relative to the handles. The disk includes at least a pair of orifices formed therein or therethrough. At least one tether or cord extends between the handles and through the orifices in the central disk. Manipulation of the handles by a user results in cyclic spinning of the disk.

14 Claims, 9 Drawing Sheets

EXERCISE DEVICE AND ASSOCIATED METHODS

PRIORITY CLAIM

Priority is claimed of U.S. Provisional Patent Application Ser. No. 61/287,096, filed Dec. 16, 2009, which is hereby incorporated herein by reference in its entirety.

FIELD OF THE INVENTION

1. Background

The present invention relates generally to exercise devices. More specifically, the present invention relates to hand-held exercise devices that incorporate a disk spinnable about or with one or more cords.

2. Related Art

Numerous personal exercise devices have been developed over the years. Some such devices are very heavy and bulky, and not easily transported from one location to another. Other such devices have been simplified to enable ease of transportation. However, many times such simplification has resulted in diminishing the benefit received by users from utilizing the devices. All such conventional devices have failed to provide a simple, easy-to-use device that is lightweight and portable, and provides an efficacious physical workout for those who use it.

SUMMARY OF THE INVENTION

In accordance with one embodiment, the present invention provides an exercise device, including a pair of outer handles and an inner, central disk, rotatable relative to the handles. The disk can include at least a pair of orifices formed therein or therethrough. At least one tether or cord can extend between the handles and through the orifices in the central disk. Manipulation of the handles by a user results in cyclic spinning of the disk in alternately opposing directions, which applies a force to a user of the device to exercise one or more muscle groups of the user.

In accordance with another aspect of the invention, a method of exercising is provided, including: grasping in each hand one of a pair of outer handles of an exercise device, each of the pair of outer handles being connected to at least one tether, the at least one tether being one or both of a pair of tethers extending through a pair of orifices formed in a central disk suspended between the outer handles; moving one or both of the outer handles to cause the central disk to rotate to thereby cause the pair of tethers to twist about one another; and pulling the outer handles away from one another in a cyclic pattern to apply a cyclic pulling force to the tethers to cause the central disk to alternately rotate in opposing directions of rotation to thereby exercise one or more sets of muscles of a user performing the exercise.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1A:
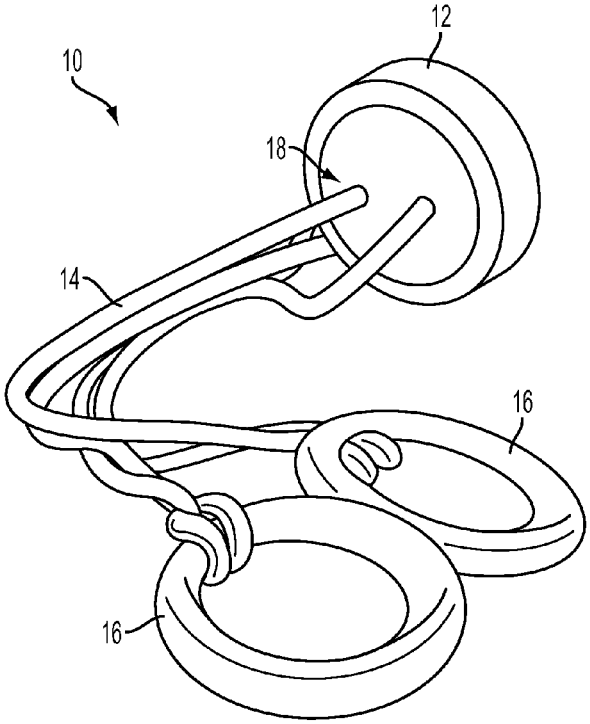
FIG. 1A is a perspective view of an exercise device in accordance with an embodiment of the invention.

It is to be understood that the figures provided herewith are intended to show the invention in the most straightforward manner, and are not necessarily drawn to scale. Also, not all features of the invention are shown in each view; some features of the invention are omitted from various views in order to simplify the presentation of information herein.

DETAILED DESCRIPTION

Before the present invention is disclosed and described, it is to be understood that this invention is not limited to the particular structures, process steps, or materials disclosed herein, but is extended to equivalents thereof as would be recognized by those of ordinarily skilled in the relevant arts. It should also be understood that terminology employed herein is used for the purpose of describing particular embodiments only and is not intended to be limiting.

It must be noted that, as used in this specification and the appended claims, the singular forms "a" and "the" can include plural referents, unless the context clearly dictates otherwise. Thus, for example, reference to a "ring" can include reference to one or more of such rings.

DEFINITIONS

In describing and claiming the present invention, the following terminology will be used in accordance with the definitions set forth below.

Relative directional terms, such as "upper," "lower," "top," bottom," etc., are used herein to aid in describing various features of the present system. It is to be understood that such terms are generally used in a manner consistent with the understanding one of ordinary skill in the art would have of such systems. Such terms should not, however, be construed to limit the present invention.

As used herein, the term "substantially" refers to the complete, or nearly complete, extent or degree of an action, characteristic, property, state, structure, item, or result. As an arbitrary example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. As another arbitrary example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint.

Distances, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 inch to about 5 inches" should be interpreted to include not only the explicitly recited values of about 1 inch to about 5 inches, but also include individual values and sub-ranges within the indicated range. Thus, included in this numerical range are individual values such as 2, 3, and 4 and sub-ranges such as from 1-3, from 2-4, and from 3-5, etc.

This same principle applies to ranges reciting only one numerical value and should apply regardless of the breadth of the range or the characteristics being described.

Invention

Figure 1B:
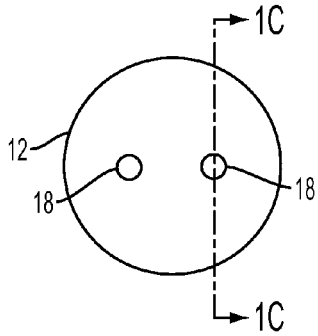
FIG. 1B is a plan view of the disk of the exercise device of FIG. 1A, shown with the rings and cords removed.

The present invention generally provides devices and methods for exercising various muscle groups of the human body. One exemplary device in accordance with one embodiment of the invention is shown at 10 in FIG. 1A. In this embodiment, the device includes a pair of handles or rings 16, between which extends one or more cords or tethers 14. In the embodiment shown, a single cord is utilized; it is attached to and extends from one ring, is attached to the other ring, and extends back to and is again attached to the initial ring. In this manner, the equivalent of two cords is established between the two rings. A central disk 12 is provided that can include a pair of orifices 18 formed therethrough (see FIG. 1B for a more clear illustration of the central disk and orifices).

In general operation, the rings 16 are manipulated by a user in such a way to cause the cord or cords 14 (sometimes referred to as a pair of cords) to twist relative to one another, which in turn results in the central disk 12 spinning rapidly and creating forces on the user's hands (which are grasping the disks). In this manner, a variety of different exercises can be provided by the invention, depending upon the manner in which the rings are grasped, the position relative to the person's various muscle groups in which the rings are held, the force applied to the cord, the fingers used to grasp the rings, etc.

The cord 14 utilized with the present invention can be formed from a variety of materials and in a variety of configurations. Generally, however, the cord is relatively flexible and bendable. Suitable materials for use in the cord include, without limitation, natural or synthetic twine, nylon cording, natural or synthetic string, and the like.

Figure 2:
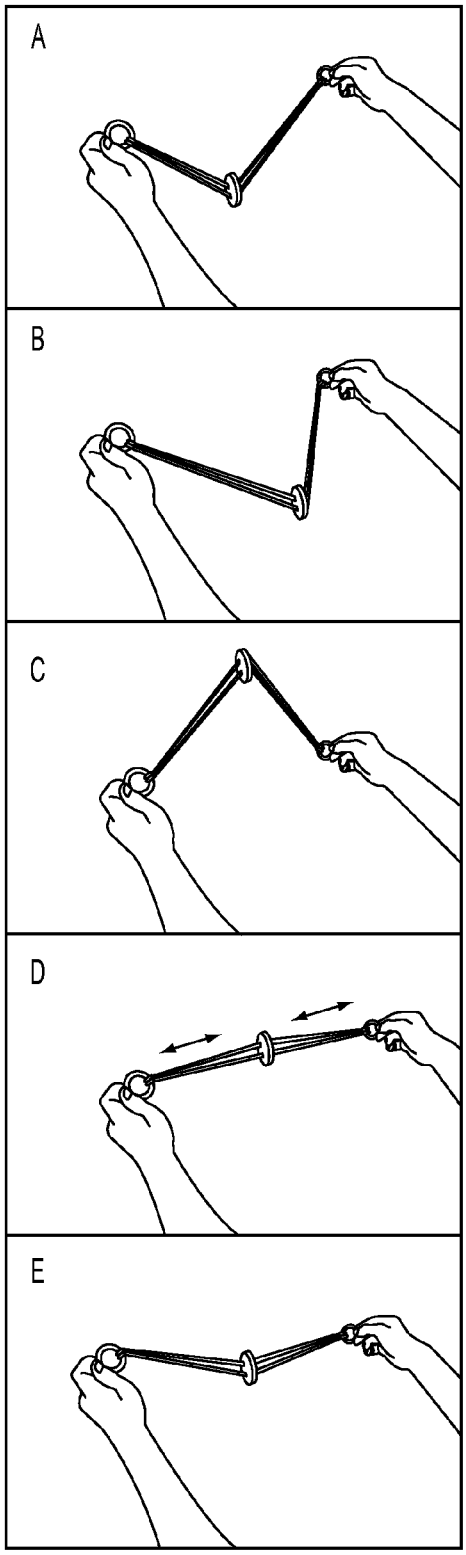
FIG. 2 includes a series of views illustrating basic uses of the exercise device of the present invention.

FIG. 2 includes a series of illustrations that teach basic techniques for manipulating the device 10. The following description can be used to instruct a user of the device in basic use of the device:

FIG. 2A: grasp one of each of the rings of the device in each hand and position the disk approximately midway between the rings;

FIG. 2B: extend arms and hold the rings approximately 6-8 inches apart. Then, spin the disk gently around 20 times to cause the cords to twist about themselves;

FIG. 2C: the cords will gradually appear to become shorter and thicker (as they twist upon themselves), at which point the device has been "wound" for use;

FIG. 2D: pull simultaneously outward on each ring to initiate rotation of the disk. Immediately release pressure, allowing the disk to rewind in the opposite direction (the pressure should be released prior to the point at which the cords or tethers transition between unwinding from one direction and winding in another direction);

FIG. 2E: once the rotation of the disk is felt to diminish, pull smoothly outwardly again, repeating the initial pattern. Repeat this procedure to create a cyclic rhythm that can be maintained for an extended period of time.

By executing the procedures outlined immediately above, the user can cause the central disk to cyclically and alternately rotate in opposing directions: this cyclic motion of the disk (or creation of this cyclic motion) applies stress to various muscle groups of the user, thereby exercising these various muscle groups.

The central disk 12 and outer handles can 16 can be formed in a variety of configurations and from a variety of materials. In the embodiments shown, the central disk is substantially a short cylinder formed of a metallic material, such as aluminum, stainless steel, and the like. While a cylinder is shown, it is understood that the central disk can be formed in variety of shapes, include generally square or rectangular shapes, triangular shapes, etc. So long as the shape of the disk results in it being capable of being spun in cyclic, alternately opposing directions, virtually any shape can be utilized.

Similarly, while the handles 16 are shown as being generally toroidal rings, they can be formed in a variety of shapes and configurations that are suitable for grasping by a user of the device.

As described above, the cord or tether 14 can either comprise a single piece of material that is wrapped twice through the disk 12 and connected to the handles 16, or can comprise two separate pieces of material that are each attached to the handles. In either case, the resulting configuration is a pair of tethers or cords, separated by a small gap, that extend through the disk. It is by twisting these tethers or cords about one another that allows a spinning motion to be imparted to the disk as the handles are pulled away from one another (thereby "un-twisting" the tethers and causing the disk to spin).

Repeated application of pulling forces to the handles causes a surprisingly powerful spinning motion of the disk that alternates directions of spin as force is cyclically applied to and released from the handles. This cyclic, alternating force provides a surprisingly good exercise regime for the muscles of the arms, back, abdomen, etc. (depending upon how and where the device is held, as is discussed in further detail below). The muscle groups used in pulling the rings or handles are stressed repeatedly in a cyclic manner: they are stressed as they apply the force to pull the rings or handle away from one another; and they are also stressed as the centrifugal force of the spinning disk tightly coils the pair of cords leading up to and just prior to the point where the direction of rotation of the disk must change (e.g., as the spinning disk coils the cords and thereby pulls the handles toward one another).

Figure 1C:
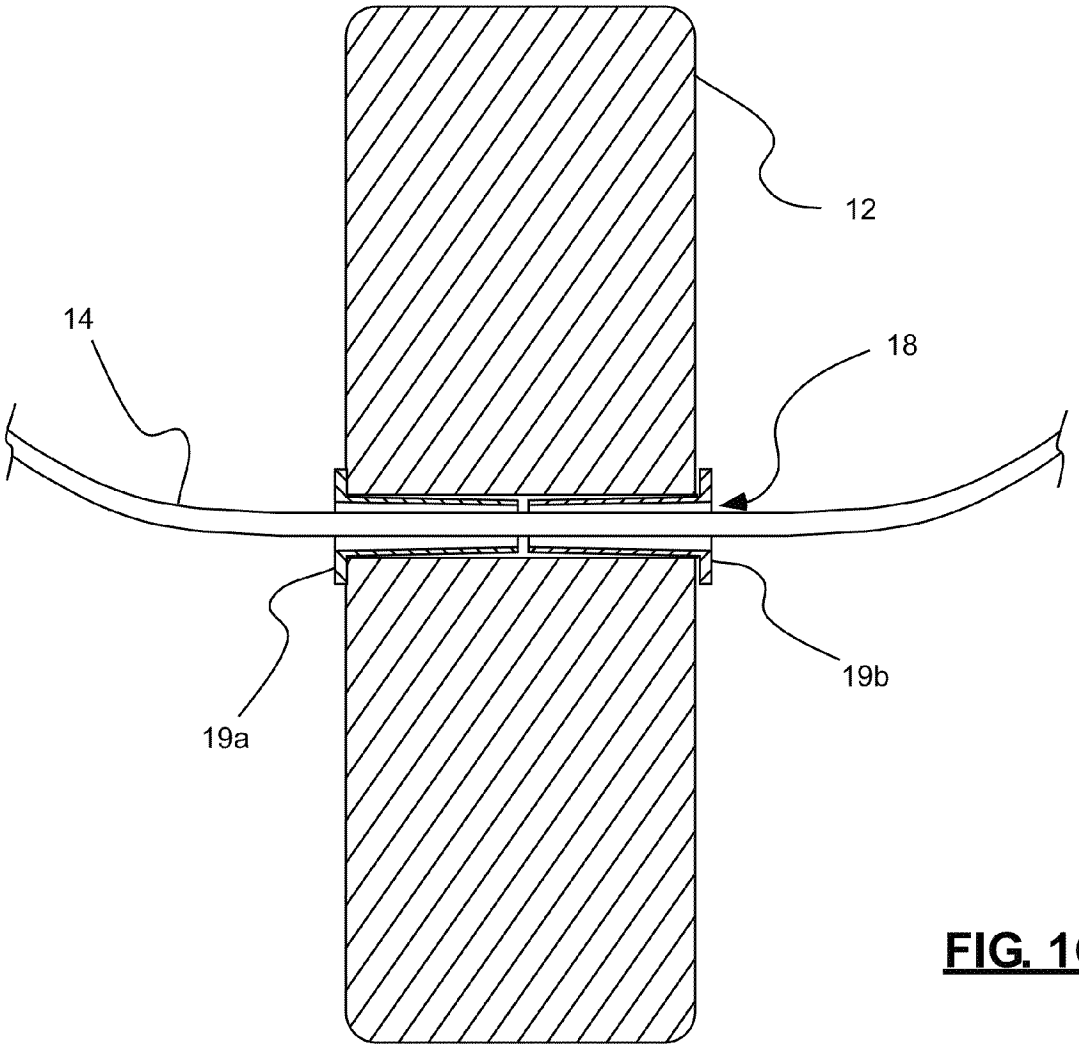
FIG. 1C is a sectioned view of the disk of FIG. 1A, taken along section C-C of FIG. 1B, shown with a cord extending through an orifice of the disk and with a pair of grommets installed within the orifice.

As shown in FIG. 1C, in one aspect of the invention, a grommet or bushing 19*a*, 19*b* can applied to or through the orifices 18 formed in the disk to reduce wear on the tether or cord 14 and to reduce friction between the disk 12 and the tether. The grommet is typically formed from a material that is relatively more soft than the disk material. In the embodiment shown, a pair of grommets 19*a*, 19*b* are utilized, each being inserted into the disk from an opposing side of the disk. In other embodiments, a single piece can be used, and can extend from one side of the disk to another without interruption. Similarly, when two grommets are utilized, they can tightly abut one another within the orifice; or they can overlap slightly to ensure that the entire internal surface of the orifice is covered.

Figure 3:
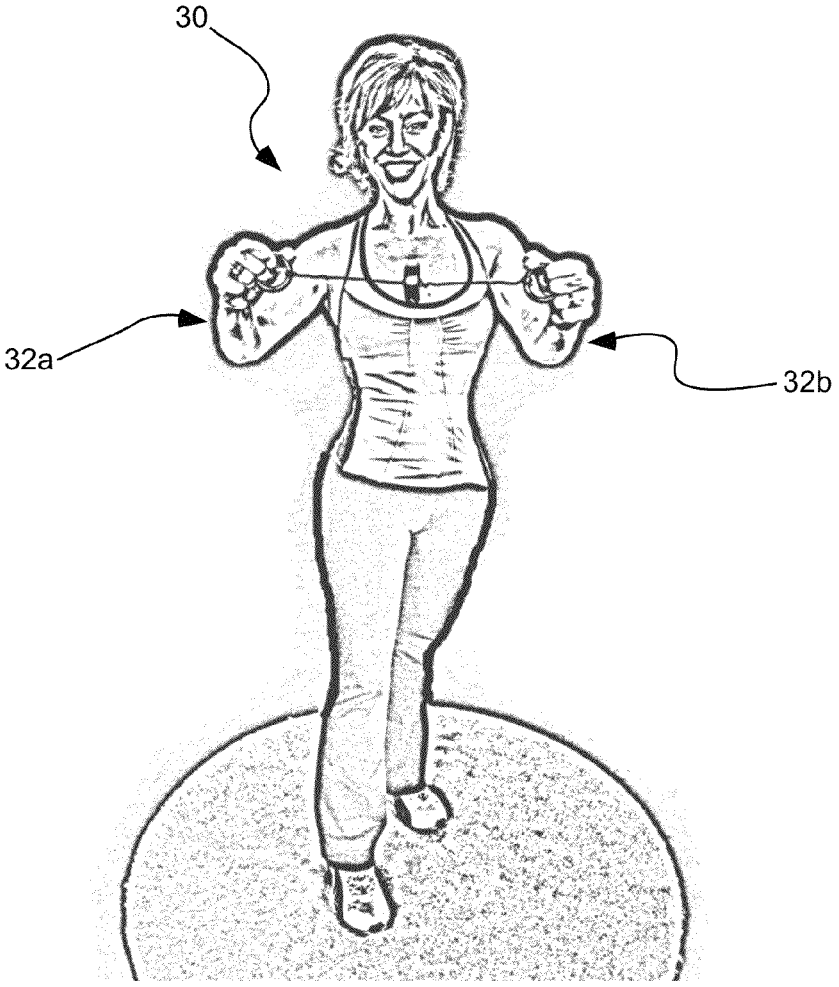
FIG. 3 is a perspective view illustrating one exemplary exercise that can be performed with the present invention.
Figure 4:
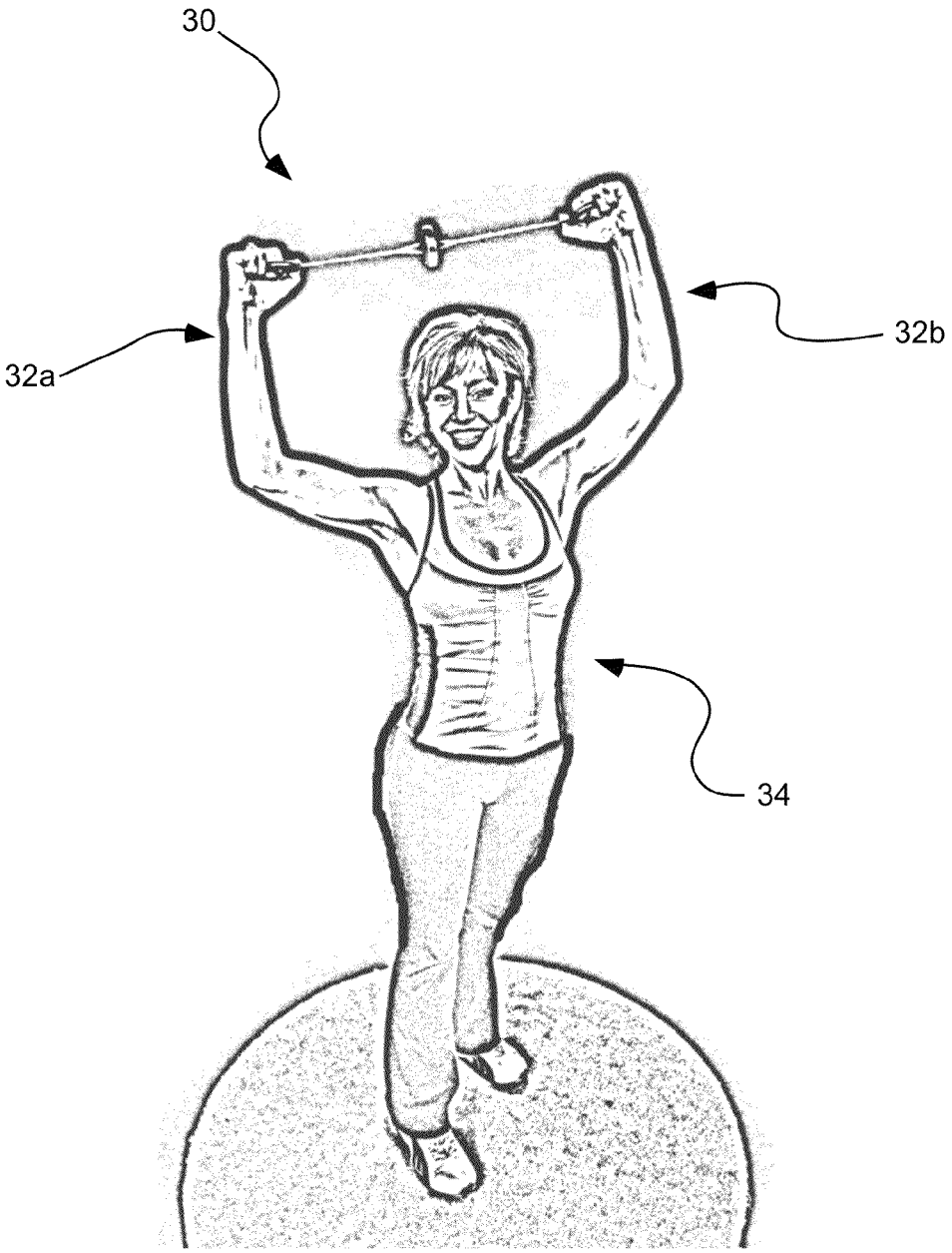
FIG. 4 is a perspective view illustrating another exemplary exercise that can be performed with the present invention.

A variety of variations on the basic use of the device can be achieved by varying the manner in which the handles 16 are grasped by the user, and the distance from a user's body the device is held, as well as the location of the device relative to the user's torso. A sampling of viable exercises that can be achieved are shown in FIGS. 3 through 8. In FIG. 3, an exercise is shown in which the tethers 14 are pulled substantially orthogonally to the forearms 32*a*, 32*b* of a user 30. In this exercise, the device is held at approximately shoulder height in front of the user, with the user's arms nearly (but not fully extended). A similar exercise is shown in FIG. 4, but in this case the device is held above the user's head as it is actuated.

Figure 5:
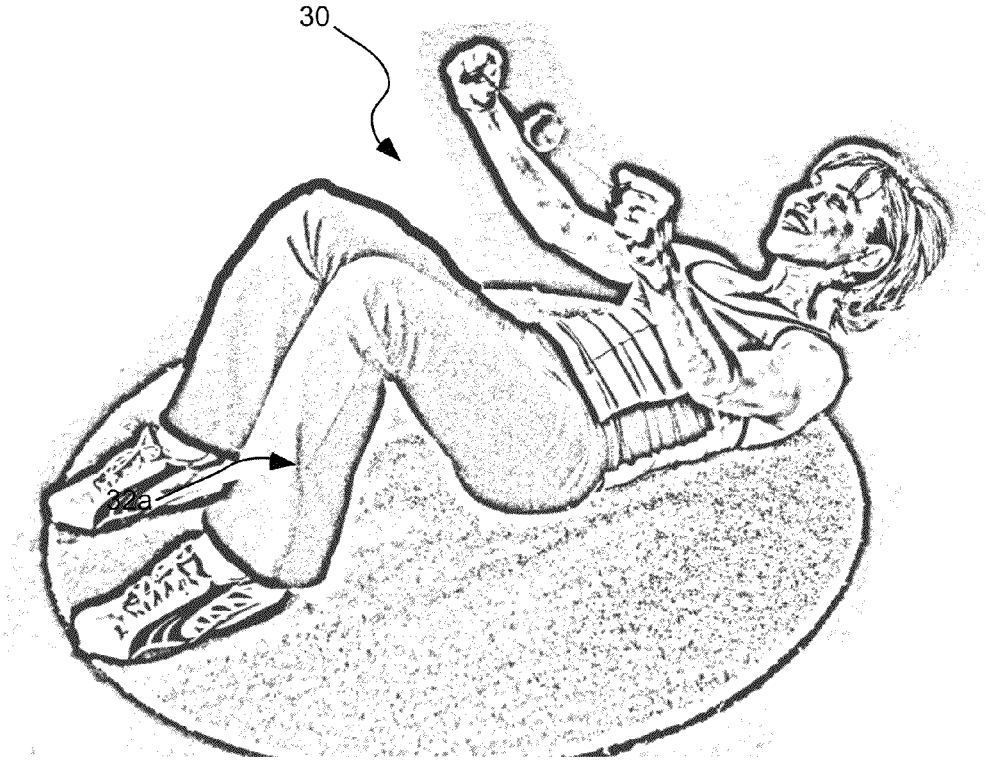
FIG. 5 is a perspective view illustrating another exemplary exercise that can be performed with the present invention.

FIG. 5 illustrates a variation on the exercise in which the user assumes a partially or fully prone position while manipulating the device. The user can also add to the workout by doing partial "crunches" or "sit-ups" while manipulating the device to enhance the physical exercise obtained while doing the exercise.

Figure 6:
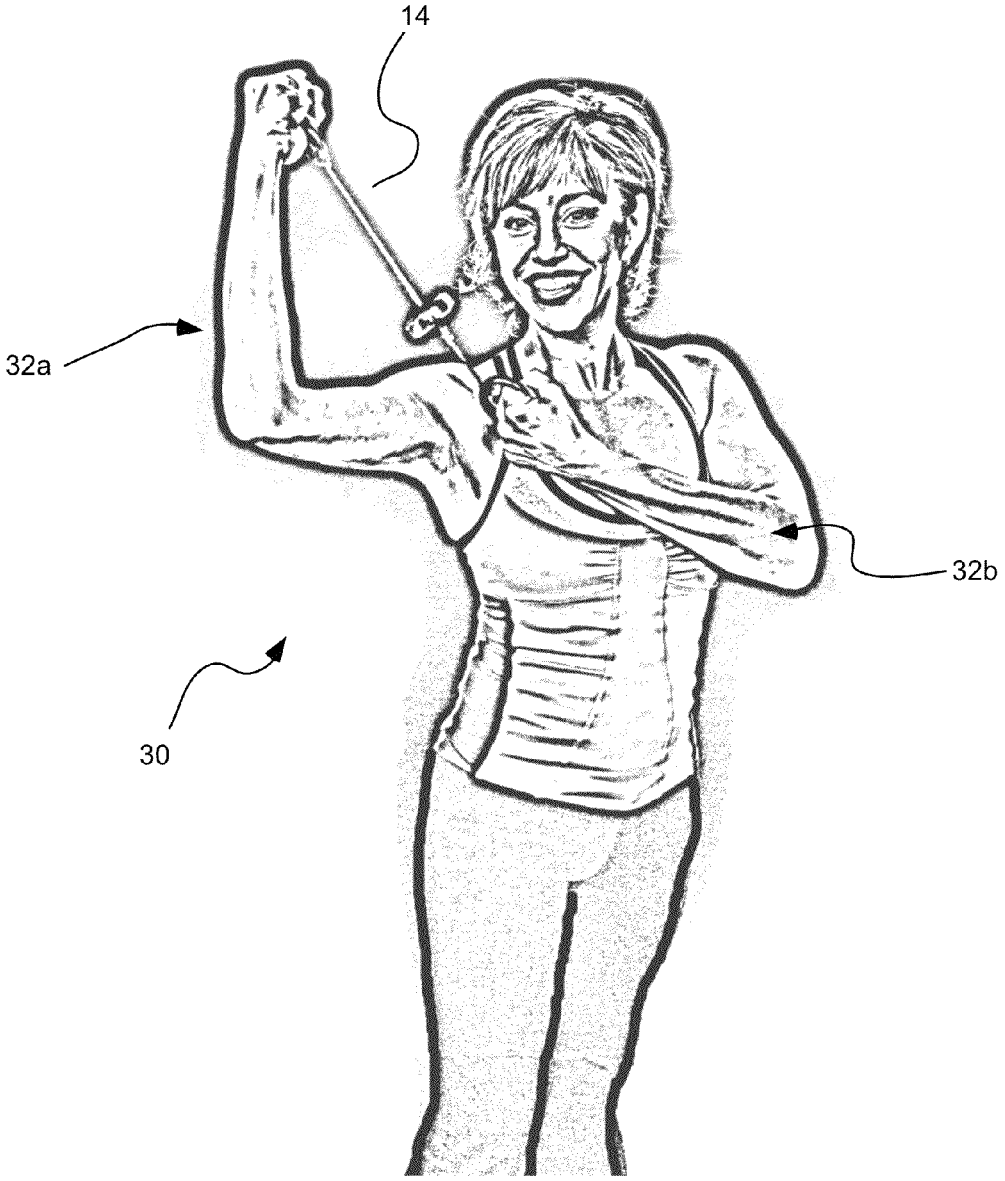
FIG. 6 is a perspective view illustrating another exemplary exercise that can be performed with the present invention.
Figure 7:
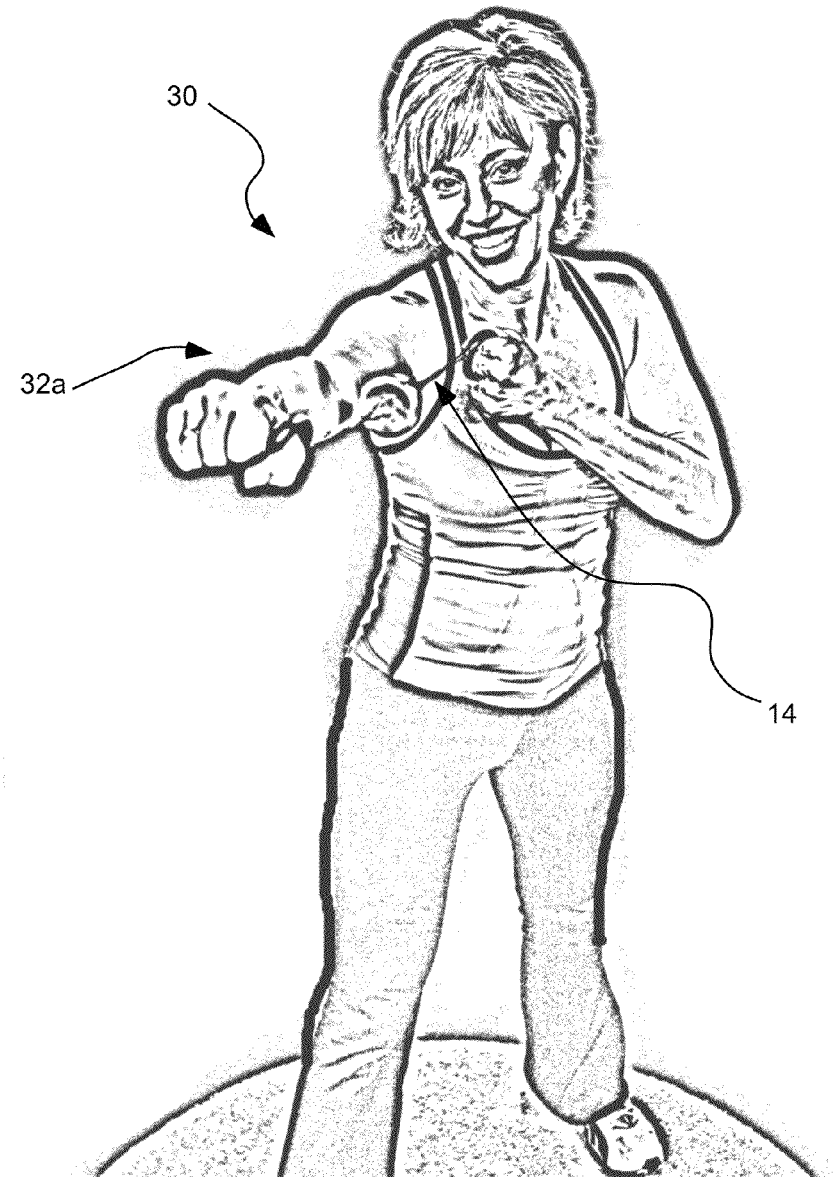
FIG. 7 is a perspective view illustrating another exemplary exercise that can be performed with the present invention.
Figure 8:
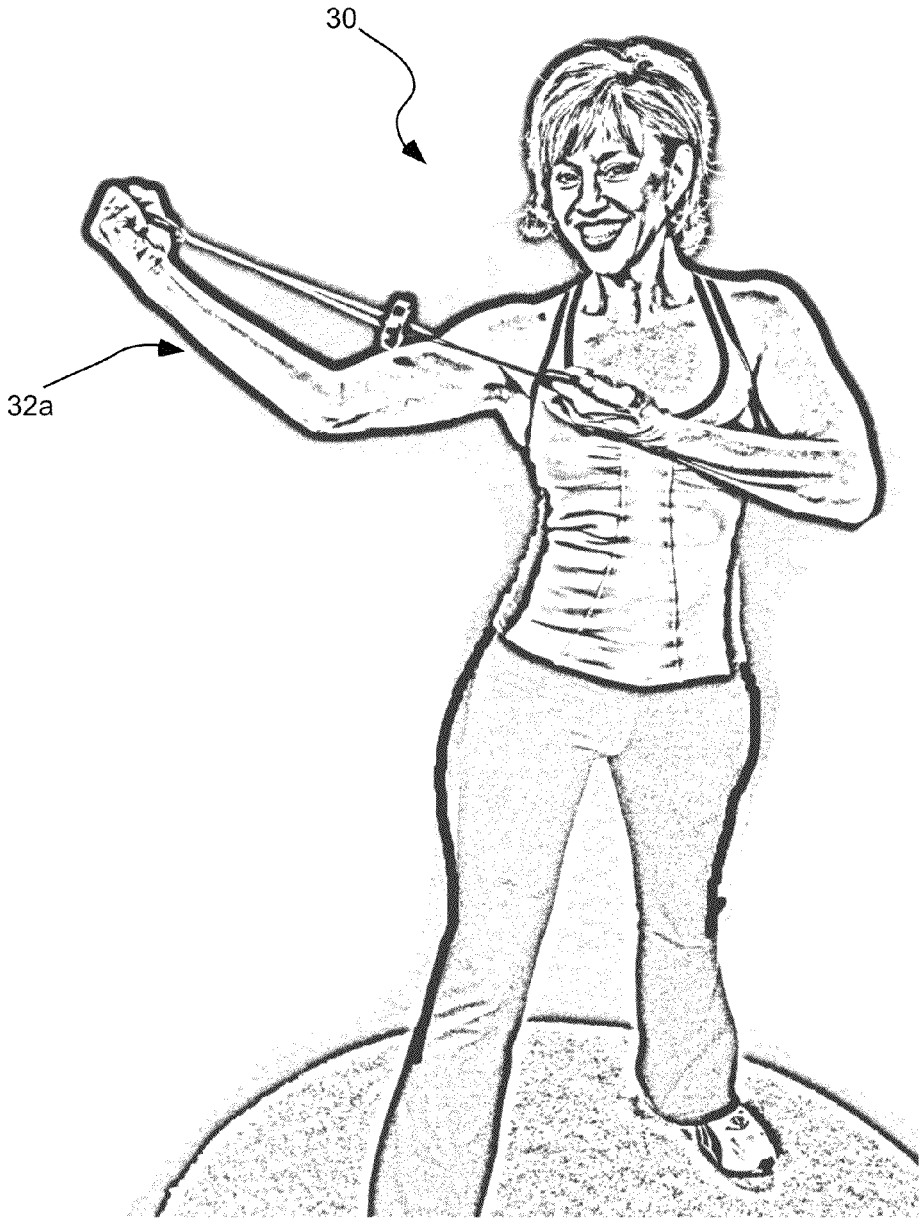
FIG. 8 is a perspective view illustrating another exemplary exercise that can be performed with the present invention.

FIG. 6 illustrates an alternate use of the device in which the cords or tethers 14 of the device are maintained in a position that is substantially parallel to (or nearly parallel to) forearm 32*a* of the user while manipulating the device. While the exact angle between the cords or tethers can vary, in one aspect, the angle can range from about 0 degrees (e.g., parallel) to around 45 degrees. This type of exercise applies a much different force through the forearm of the user than when used in an orientation closer to orthogonal to the forearms. FIGS. 7 and 8 illustrate variations on the parallel orientation, with the exercise in FIG. 7 requiring that the device be manipulated while held in a stance similar to that used when shooting a bow. The exercise shown in FIG. 8 requires that the device be manipulated while held substantially parallel to a plane formed by the shoulders of the user.

In addition to the exercises described above (and shown in the figures), the present invention can be utilized as a stretching aid that can be used prior to an exercise session utilizing the device (or as a stand-alone stretching aid). In one aspect, for example, the cords 14 can be wrapped about a user's appendage (e.g., ankle, knee, arm, etc.) and the handles can be held in one or two hands. By applying a force against the cords (and opposing the force with the hand or hands holding the handles), the user can stretch one or more muscle groups.

The present invention also provides the advantage of being very compact and portable: the entire device can be stored within a very small bag (on the order of the size of an eyeglass case) for ease of transportation and storage.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

I claim:

1. A method of exercising, comprising:

engaging an appendage of the user's body with one of a pair of outer handles of an exercise device, each of the pair of outer handles being connected to at least one tether, the at least one tether being one or both of a pair of tethers extending through a pair of orifices formed in a central disk suspended between the outer handles;

stretching the appendage by applying a force against the tether prior to performing an exercise;

after stretching the appendage, grasping in each hand one of the pair of outer handles of the exercise device;

moving one or both of the outer handles to cause the central disk to rotate to thereby cause the pair of tethers to twist about one another; and pulling the outer handles away from one another in a cyclic pattern to apply a cyclic pulling force to the tethers to cause the central disk to alternately rotate in opposing directions of rotation to thereby exercise one or more sets of muscles of a user performing the exercise.

2. The method of claim 1, wherein moving the pair of outer handles comprises moving the handles in a direction substantially orthogonally to axes of forearms of a user performing the exercise.

3. The method of claim 2, wherein the forearms of the user are held substantially parallel to one another in front of a torso of the user.

4. The method of claim 2, wherein the forearms of the user are held substantially parallel to one another above a torso of the user.

5. The method of claim 2, further comprising assuming a substantially prone position prior to pulling the outer handles away from one another.

6. The method of claim 2, further comprising assuming a sitting position prior to pulling the outer handles away from one another.

7. The method of claim 1, wherein the outer handles and central disk are held substantially behind a torso of the user while performing the exercise.

8. The method of claim 1, wherein moving the pair of outer handles comprises moving the handles such that the tethers are oriented in a direction substantially parallel to an axis of a forearm of a user performing the exercise.

9. The method of claim 8, wherein the forearm axis is held so as to extend substantially forward of a torso of the user while performing the exercise.

10. The method of claim 8, wherein the forearm axis is held substantially upwardly adjacent a head of the user while performing the exercise.

11. The method of claim 8, further comprising bending the torso prior to pulling the outer handles away from one another and maintaining a bent orientation while performing the exercise.

12. The method of claim 8, further comprising assuming a sitting position prior to pulling the outer handles away from one another and maintaining the sitting position while performing the exercise.

13. The method of claim 8, wherein the outer handles and central disk are held substantially behind a torso of the user while performing the exercise.

14. The method of claim 1, wherein the appendage comprises a leg of a user or an arm of a user.

* * * * *